US006835073B2

(12) United States Patent
Kobayashi

(10) Patent No.: US 6,835,073 B2
(45) Date of Patent: Dec. 28, 2004

(54) JUNCTION BOX

(75) Inventor: Nobuchika Kobayashi, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 10/640,404

(22) Filed: Aug. 14, 2003

(65) Prior Publication Data

US 2004/0048520 A1 Mar. 11, 2004

(30) Foreign Application Priority Data

Aug. 19, 2002 (JP) ..... 2002-238482

(51) Int. Cl.[7] ..... H01R 12/00
(52) U.S. Cl. ..... 439/76.2; 439/709; 439/449
(58) Field of Search ..... 439/76.2, 709, 439/749

(56) References Cited

U.S. PATENT DOCUMENTS 5,777,850 A * 7/1998 Jakob et al. ..... 361/736
5,928,004 A * 7/1999 Sumida et al. ..... 439/76.2
6,126,457 A * 10/2000 Smith et al. ..... 439/76.2
6,315,578 B1 * 11/2001 Kasai et al. ..... 439/76.2
6,430,054 B1 * 8/2002 Iwata ..... 361/752
6,511,331 B2 * 1/2003 Saito et al. ..... 439/76.2
6,514,091 B2 * 2/2003 Saito et al. ..... 439/76.2
6,561,822 B2 * 5/2003 Depp et al. ..... 439/76.2
6,583,353 B2 * 6/2003 Murakoshi et al. ..... 174/50
6,634,892 B2 * 10/2003 Nakamura ..... 439/76.2
6,655,967 B2 * 12/2003 Oda ..... 439/76.2

FOREIGN PATENT DOCUMENTS

JP A 2000-125449 8/2000

* cited by examiner

*Primary Examiner*—Ross Gushi
(74) *Attorney, Agent, or Firm*—Oliff & Berridge, PLC

(57) ABSTRACT

A junction box 10 includes an upper casing member 11 and a lower casing member 16 and is provided with a side opening 11*c* to which a fuse module 17 is attached. The fuse module 17 contains an insulation board 27 on which a bus bars 23, 24 are secured. The bus bars are connected to terminals 30*a*, 30*b* of a plurality of fuses 30 mounted in a fuse casing 18 in a juxtaposed manner. Fuse casing locking-portions 11*d* and 16*b* project from an upper surface of the upper casing member 11 and a lower surface of the lower casing member 16 at the side of the side opening 11*c*. Portions being locked 18*b* are provided in the fuse casing 18 to engage the locking-portions 11*d* and 16*b* on the upper and lower casing members 11 and 16. The upper and lower casing members 11 and 16 are interlocked through the fuse casing 18.

6 Claims, 6 Drawing Sheets

JUNCTION BOX

The entire disclosure of Japanese Patent Application No. 2002-238482 filed on Aug. 19, 2002 including the specification, claims, drawings and summary is incorporated herein by reference in its entirety.

BACKGROUND OF THE INVENTION

1. Field of Invention

This invention relates to a junction box and more particularly it relates to a junction box that is connected to a wire harness for an automobile and firmly holds a fuse module in a side opening.

2. Description of Related Art

Recently, as electrical components installed on an automobile have suddenly increased, so has the number of circuits contained in a junction box. The number of parts to form branched circuits at a high density has also increased extremely. This increase requires many assembling steps.

For convenience of explanation, a prior art junction box will be described by referring to FIG. 7. FIG. 7 is an exploded perspective view of a conventional junction box 1.

The present applicant has proposed a junction box as shown in FIG. 7 in order to form a thin type junction box, to easily change a circuit design, and reduce assembling steps.

In junction box 1, a connector connecting circuit section (base circuit section), a fuse connecting section, and a relay connecting section are divided into a connector module 5, a fuse module 8, and a relay module 6. An ECU (electronic control unit) 3, an insulation board 4, a connector module 5, and a relay module 6 are stacked from an upper stage to a lower stage in order in a casing that includes an upper casing member 2 and a lower casing member 7.

An opening 2*c* is formed on a sidewall of the upper casing member 2. A fuse casing 9 of the fuse module 8 is attached to the opening 2*c*. Locking-portions 2*b* on opposite sidewalls 2*a* of the upper casing member 2 engage portions being locked 7*a* on opposite sidewalls of the lower casing member 7 and the fuse module 8 is attached to the upper and lower casing members 2 and 7.

In the case where the junction box is divided into the connector module, fuse module, relay module, and relay module, each are divided into the connector connecting circuit, fuse connecting circuit, and relay connecting circuit. Accordingly, tabs of bus bars are not overlapped. Consequently, it is possible to suppress a multi-lamination of the bus bars and to reduce a thickness of the junction box. Since an arrangement of a bus bar circuit becomes simple, it is possible to reduce an area of the bus bar. Even if the bus bar is divided, it is still possible to reduce a whole area of the bus bar and to suppress an increase of area of the junction box.

Furthermore, if there is an alteration in the specification, for example, in a connector circuit, a fuse circuit, or a relay circuit, only a corresponding module can be altered. This can comply with an alteration in specification and, thus, an alteration in the circuit.

However, since the opening 2*c* is formed on a side of a peripheral wall of the upper casing 2 of the junction box 1, opposing sidewalls of the opening 2*c* are likely to be opened outwardly. When the opposing sidewalls are opened outwardly, the locking-portions 2*b* of the upper casing member 2 and the portions being locked 7*a* of the lower casing member 7 are unlocked, and casing member 2 and lower casing member 7 are detached from one another.

SUMMARY OF THE INVENTION

In view of the above problems, an object of the present invention is to provide a junction box having a side opening in which an upper and lower casing members are firmly interlocked.

In order to overcome the above problems, the present invention is directed to a junction box that includes an upper casing member and a lower casing member with a side opening to which a fuse module is attached. The fuse module contains an insulation board on which a bus bar is secured. The bus bar is connected to terminals of each of a plurality of fuses mounted in a fuse casing in a juxtaposed manner. Fuse casing locking-portions project from an upper surface of the upper casing member and a lower surface of the lower casing member at the side opening. The portions being locked are provided in the fuse casing to engage with the locking-portions on the upper and lower casing members. Thus, the upper and lower casing members are interlocked through the fuse casing.

According to the above, the fuse casing locking-portions of the upper and lower casing members are secured to the portions being locked of the fuse casing that encloses the side opening. Since the fuse casing serves as an interlocking means between the upper and lower casing members, it is possible to prevent the upper casing member from being separated away from the lower casing member, even when the opposing sidewalls of the side opening are opened outwardly.

Moreover, a fuse cover is mounted on an exterior of the fuse casing to further secure the upper casing with the lower casing. The portions being locked are provided on a peripheral wall of the fuse cover. The fuse casing locking-portions that project from the upper and lower casing members are provided on distal ends with cover locking-portions. The cover locking-portions engage the portions being locked of the fuse cover.

Furthermore, according to the above construction, the upper and lower casing members are provided on the positions opposed to the side opening with cover locking-portions while the fuse cover is provided with portions being locked. When the fuse cover is mounted on the fuse module with the fuse being contained in the fuse casing, the upper and lower casing members can be interlocked.

Thus, the upper and lower casing members are interlocked by both fuse casing and fuse cover. Such a double locking can secure the upper and lower casing members to each other more firmly.

In more detail, locking holes are provided on a stepped portion projecting from each of the upper and lower surfaces of the fuse casing so that the locking holes serve as the portion being locked. Arms that project into the side opening are provided on upper and lower surfaces of the upper and lower casing members respectively. The upper and lower surfaces are attached to the fuse casing vertically. Locking pawls for the fuse casing locking-portions are provided on the arms, so that the locking pawls are inserted into the locking holes in the fuse casing. A locking pawl is also provided on a distal end of each of the upper and lower surfaces of the upper and lower casing members so that the locking pawl serves as the cover locking-portion. The locking pawls of the cover locking portions also lock onto the periphery of the fuse cover.

Also, a connector module constituting a connector connecting circuit section is contained in an interior of a box within the upper and lower casing members. A relay module constituting a relay connecting circuit section is also attached to an opening in the upper or lower casing member. The connector module includes an insulation board and a bus bar secured to the insulation board whereas the relay module includes an insulation board and a bus bar that is connected to terminals of each relay.

The bus bar disposed vertically in the fuse module is coupled to the bus bar disposed vertically in the connector module by a resistance welding to arrange the fuse module on a side surface with the connector module. Under this condition, when the upper and lower casing members cover the fuse casing in upper and lower directions, the arms of the upper and lower casing members are deflected and the locking pawls on the arms engage the locking holes in the fuse casing. Thereby improving workability.

Still other objects and advantages of the invention will in part be obvious and apparent from the specification.

BRIEF DESCRIPTION OF THE DRAWINGS

The features of the present invention are believed to be novel and the elements characteristic of the present invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DETAILED DESCRIPTION OF PREFERRED EMBODIMENTS

Figure 1:
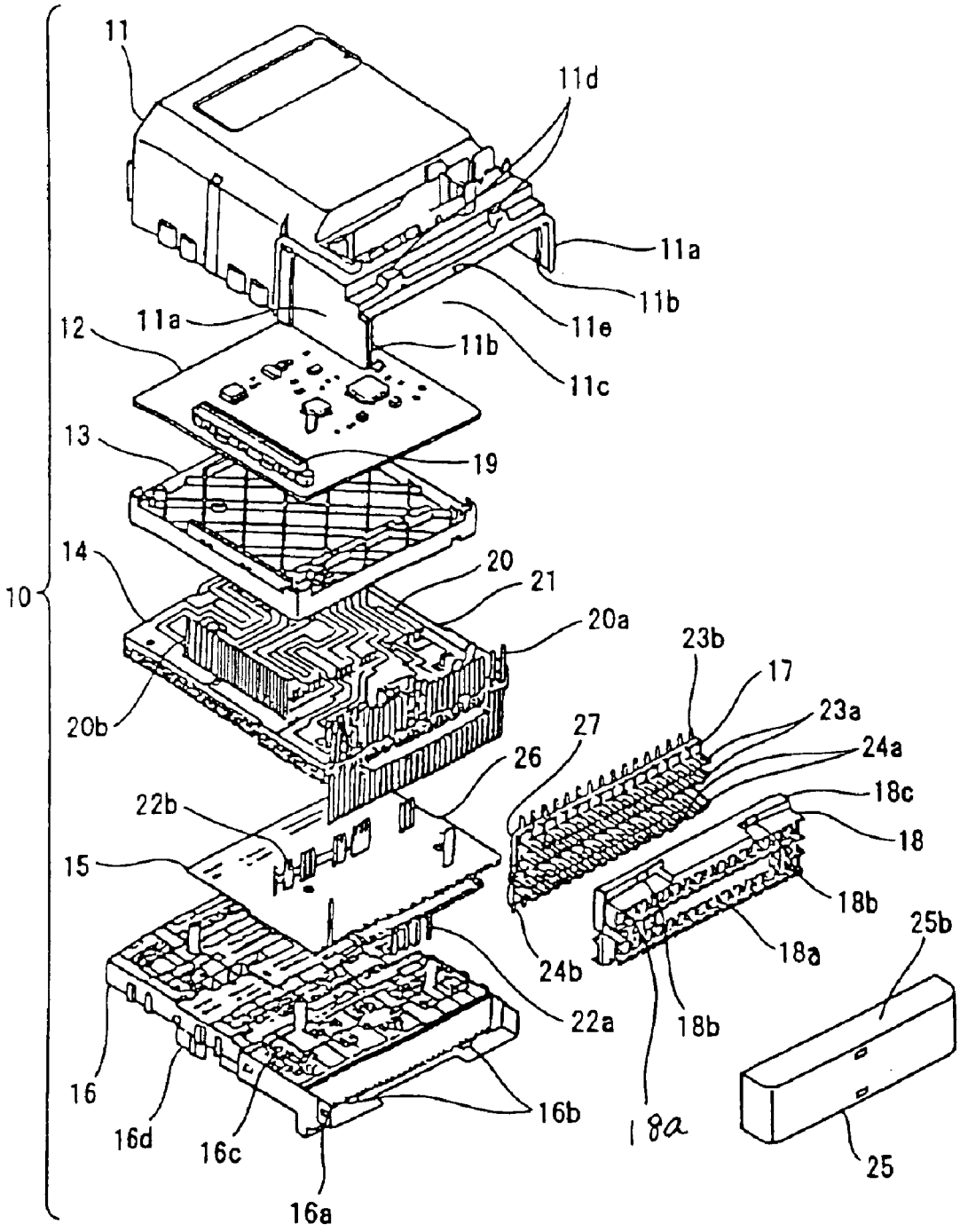
FIG. 1 is an exploded perspective view of an embodiment of a junction box in accordance with the present invention.

In describing the preferred embodiment of the present invention, reference will be made herein to FIGS. 1 to 6 in which like numerals refer to like features of the invention. Features of the invention are not necessarily shown to scale in the drawings.

Referring now to the drawings, an embodiment of a junction box in accordance with the present invention will be described below.

FIG. 1 is an exploded perspective view of a junction box 10 to be connected to a wire harness for an automobile.

In FIG. 1, the junction box 10 includes an upper casing member 11, an electronic control unit (ECU) 12, an insulation board 13, a connector module 14, a relay module 15, a lower casing member 16, a fuse module 17, and a fuse casing 18.

The relay module 15, connector module 14, insulation board 13, and electronic control unit 12 are arranged in a vertical direction (in FIG. 1) on the lower casing member 16 in order. The upper casing member 11 is mounted on the lower casing member 16. The upper casing member 11 is provided with a short side of a peripheral wall having a side opening 11*c*. The fuse module 17 is attached to the side opening 11*c* in a vertical direction.

Figure 2:
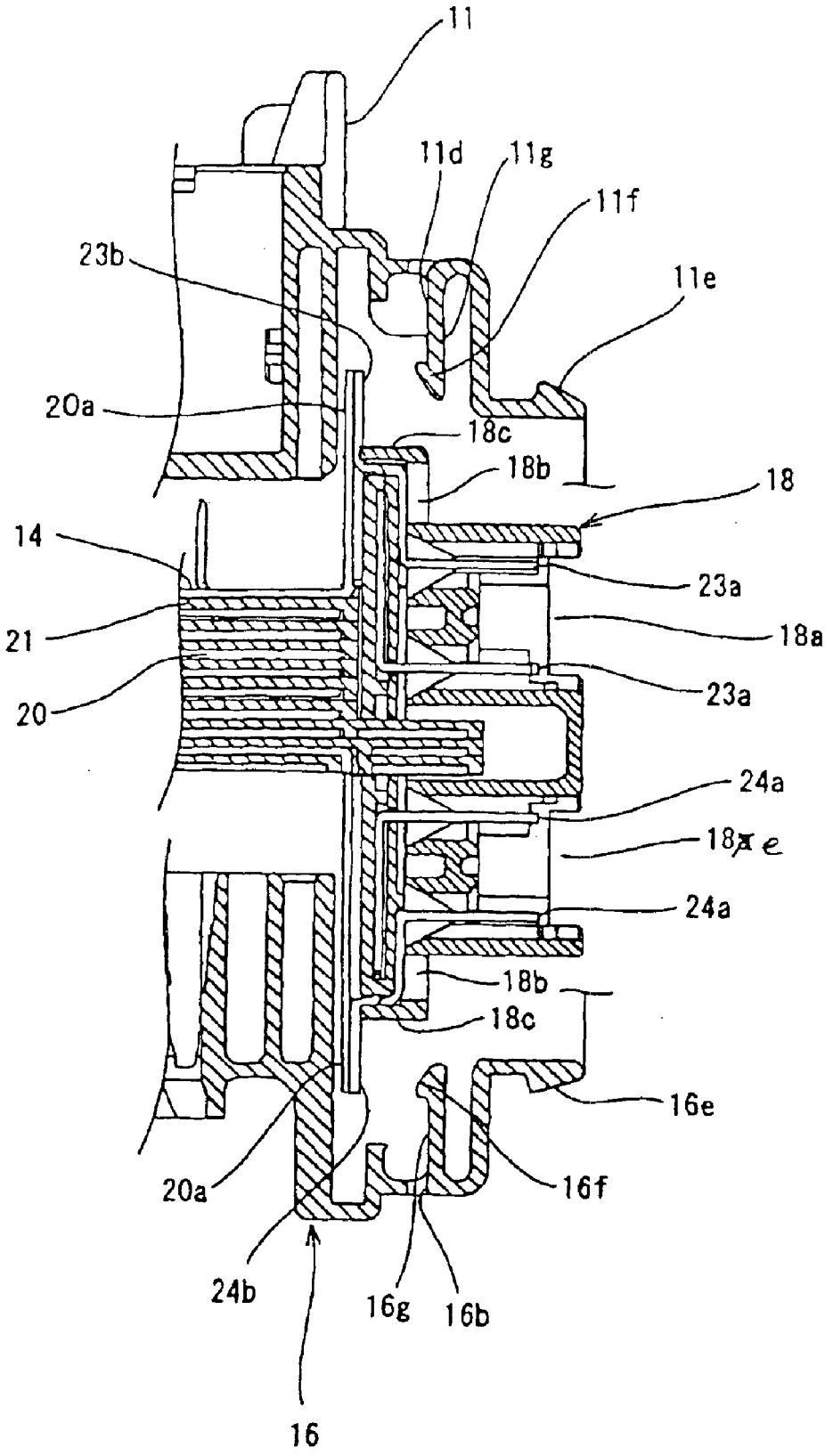
FIG. 2 is a sectional view of a main part of the junction box, illustrating positions before an upper casing member and a lower casing member are assembled.

The upper casing member 11 has a portion being locked 11*b* on an inner surface of each long side 11*a* that couples and locks with the lower casing member 16. Furthermore, as shown in FIG. 2, two arms 11*g* (only one shown) extend downward from an upper wall of the upper casing member 11 near the side opening 11*c*. Locking pawl 11*f* is provided on a lower distal end of each arm 11*g* to serve as a fuse casing locking-portion 11*d*. Locking pawl 11*e* projects upward from an upper peripheral wall of the side opening 11*c* to serve as a cover locking-portion.

As shown in FIG. 2, two arms 16*g* (only one shown) extend upward from a lower wall of the lower casing member 16 near the side opening 11*c* at a position after assembling the members 11 and 16. Locking pawl 16*f* is provided on an upper distal end of each arm 16*g* to serve as a fuse casing locking-portion 16*d*. Locking pawl 16*e* (FIG. 2) projects downward from a lower peripheral wall of the side opening 11*c* that is formed after assembling the members 11 and 16 to serve as a cover locking-portion.

The lower casing member 16 is provided on each of the opposing sidewalls with a locking pawl 16*a* that engages with portion being locked 11*b* of the upper casing member 11. Locking pawls 11*e* and 16*e* serve to interlock the upper and lower casing members 11 and 16, while the connector module 14 is housed within the assembled upper and lower casing members 11 and 16.

The lower casing member 16 has a lower surface with a plurality of connector containing sections 16*d* that couples to connector module 14 and a plurality of relay containing sections 16*c* that couples to relay module 15.

The fuse module 17 is attached to the side opening 11*c* to be disposed on a side surface of the connector module 14. The fuse module 17 contains an insulation board 27 on which bus bars 23 and 24 are secured. The bus bars 23 and 24 are connected to a pair of terminals 30*a* and 30*b* of each of fuses 30 that are juxtaposed in a fuse casing 18 (see FIG. 5).

The bus bar 23 has an end with a pair of press contact terminals 23*a* which are connected to a power source side and a load side respectively, and extend into fuse containing sections 18*a* at an upper stage of the fuse casing 18. The other end of the bus bar 23 is bent upward to form a fuse welding-tab 23*b*. Similarly, the bus bar 24 is provided on an end with a pair of press contact terminals 24*a* that are connected to a power source side and a load side, respectively and extend into fuse containing sections 18*e* at a lower stage of the fuse casing 18. The other end of the bus bar 24 is bent downward to form a fuse welding-tab 24*b*.

The fuse welding-tabs 23*b* and 24*b* are arranged on a straight line and in a juxtaposed manner to be opposed to and welded on connector welding-tabs 20*a*.

Figure 5:
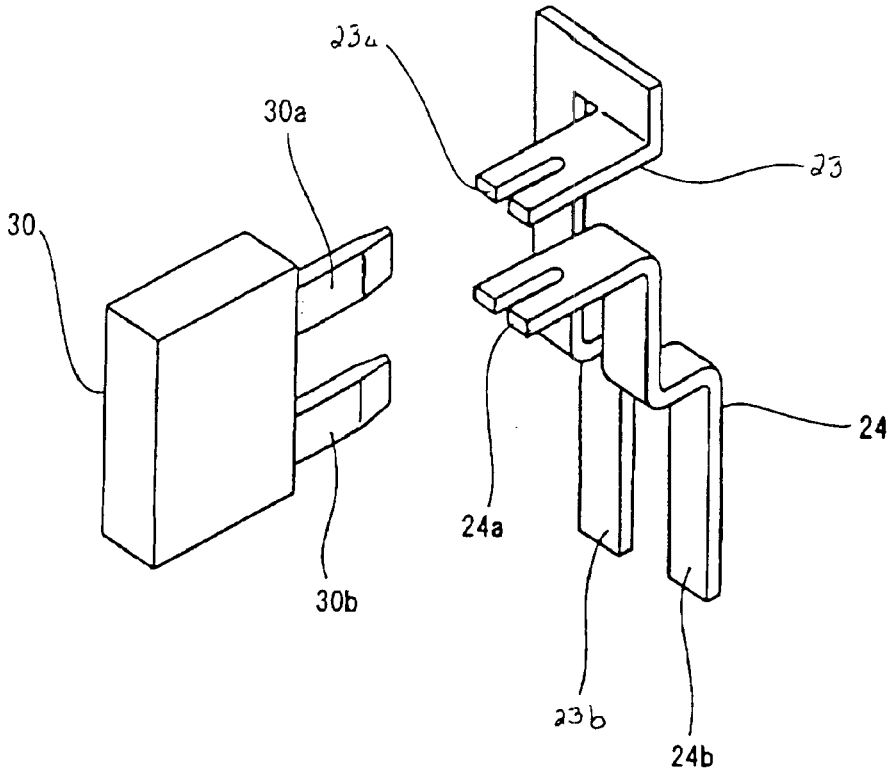
FIG. 5 is an exploded perspective view of a fuse module, illustrating a condition of connection between a fuse and a bus bar.

As shown in FIG. 5, the press contact terminals 23*a* and 24*a* receive in a press contact manner a pair of terminals 30*a* and 30*b* of the fuse 30 to be inserted into the fuse containing section 18*a*.

As shown in FIGS. 1 and 2, the fuse casing 18 is provided on upper and lower walls at a casing attachment side with stepped portions 18*c*. Locking holes 18*b* are formed in right and left sides of each stepped portion 18*c* to form portions being locked.

After the fuses 30 are mounted on the fuse casing 18, a fuse cover 25 is put on the fuse casing 18. Locking pawls (portions being locked) 25*a* are provided on central positions on the upper and lower inner surfaces of the peripheral wall 25*b* to interlock the locking pawls 11*e* and 16*e* when peripheral wall 25*b* of the fuse cover 25 is mounted on the upper surface of the upper casing member 11 and the lower surface of the lower casing member 16 on the side having the side opening 11*c*.

The connector module 14 is formed by the steps of: punching a sheet of an electric conductive plate to make a connector-coupling bus bar 20 having a desired circuit configuration; securing the bus bar 20 onto an insulation board 21 to make a circuit; and stacking a plurality of insulation boards 21 in a vertical direction in FIG. 1. An end of the bus bar 20 extends downward from the circuit to form a tab (or through a bus bar 22 of the relay module 15). The tab extends into the connector containing section 16*d* of the lower casing member 16.

The ends of the bus bars 20 are bent upward and downward on a straight line to form L-shaped connector welding-tabs 20*a* at a side of the connector module 14 that opposes the fuse module 17. The tabs can accomplish a concentrate arrangement.

Figure 6:
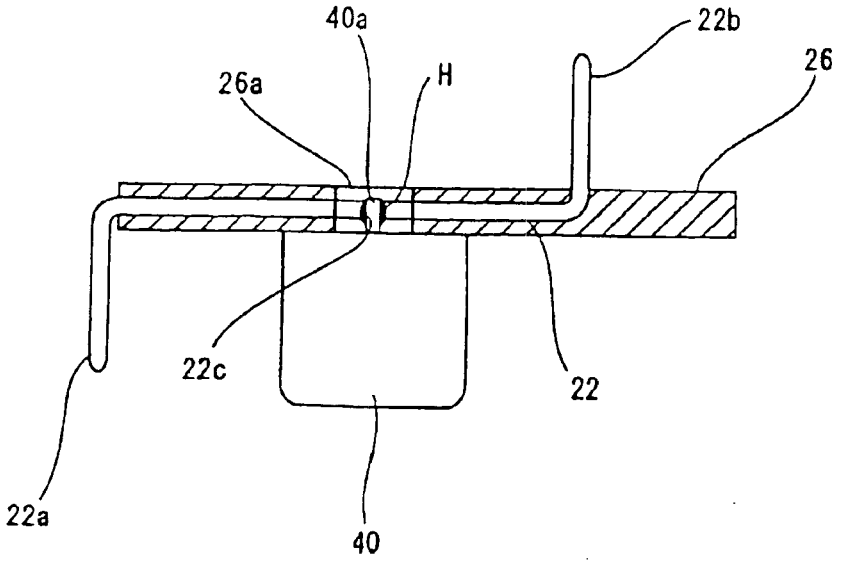
FIG. 6 is a sectional view of a relay module, illustrating a condition of connection between a relay and a bus bar.
Figure 7:
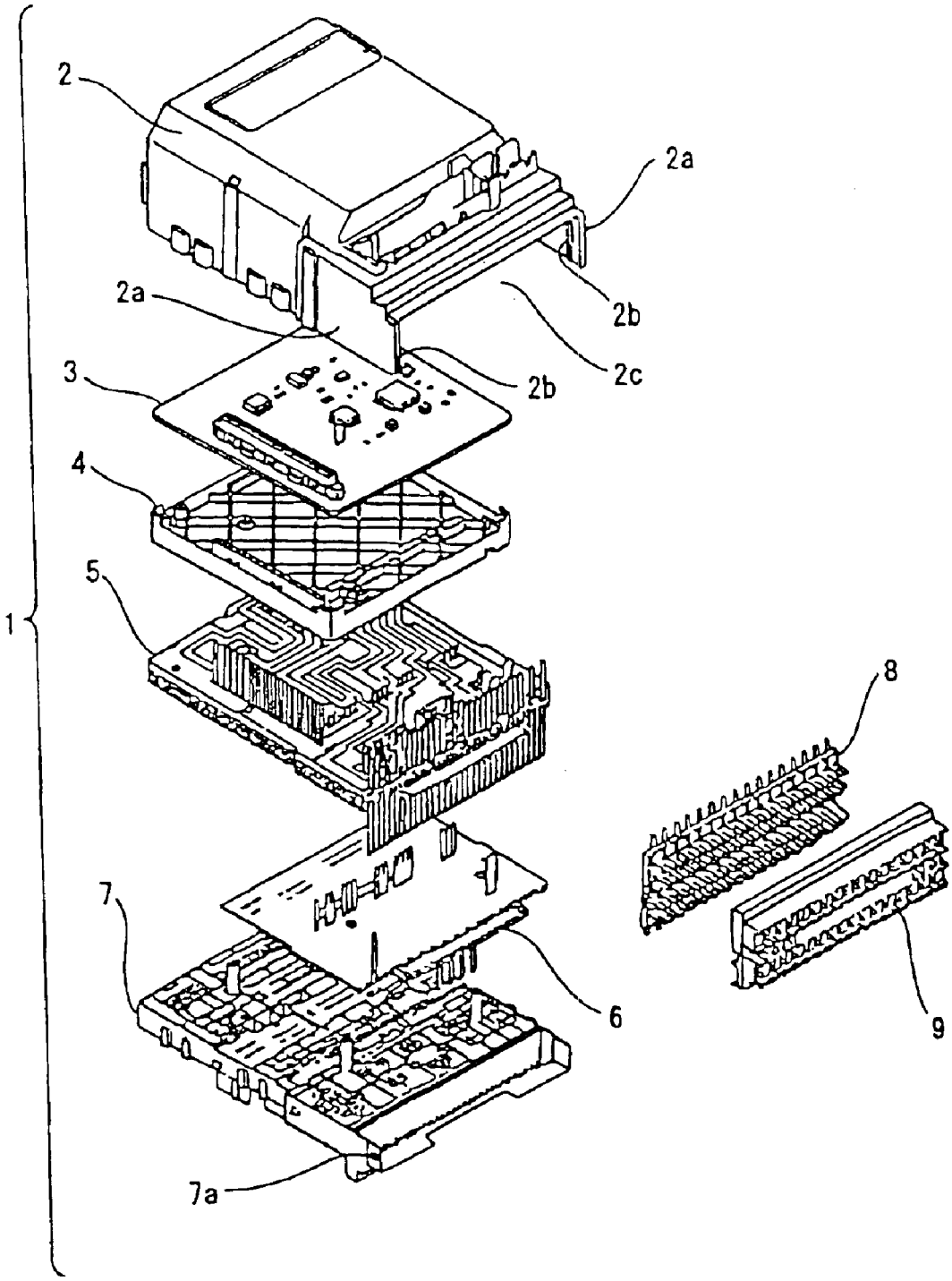
Fig. 7 RELATED ART
FIG. 7 is an exploded perspective view of a conventional junction box.

As shown in FIG. 6, the relay module 15 includes an insulation board 26 and a bus bar 22 molded in the insulation board 26. A body section of a relay 40 is mounted on a lower surface of the insulation board 26. Terminals 40*a* of the relay 40 are inserted into openings 26*a* in the insulation board 26 and openings 22*c* in the bus bar 22. The terminals 40*a* are soldered (H) in the openings 26*a* and 22*c* to form a direct board-securing type.

An end 22*b* of the bus bar 22 is bent and projected upward from the insulation board 26 so that the end 22*b* is connected to the bus bar 20 of the connector module 14. The other end 22*a* of the bus bar 22 is bent and projected downward from a side surface of the insulation board 26 at the side of the fuse module 17 so that the other end 22*a* is opposed to the connector welding-tab 20*a* of the connector module 14 on a strait line and in a juxtaposed manner.

The electronic control unit 12 contains a board with an upper surface of which electronic parts are installed on. The electronic control unit 12 is stacked through the insulation board 13 on the connector module 14.

Conductors are printed on a side of the board of the unit 12 so that the conductors are connected to vertical relay terminals (not shown) in the ECU connector 19. Lower ends of the relay terminals are connected to the tabs 20*b* of the bus bar 20 of the connector module 14.

Next, an assembling process of the junction box 10 comprising the above components will be described below.

The relay module 15, connector module 14, insulation board 13, and electronic control unit 12 are stacked one after another in order so that the conductors of the electronic control unit 12 are connected through the relay terminals to the bus bar 20 of the connector module 14.

The fuse module 17 is disposed so that the fuse welding-tabs 23*a* and 24*a* of the fuse module 17 are opposed to the connector welding-tabs 20*a* projecting from the side surface of the connector module 14. The connector welding-tabs 20*a* and fuse welding-tabs 23*a* and 24*a* are brought into contact with each other and welded in sequence.

In the above welding, the relay welding-tabs 22*a* of the relay module 15 are piled on the connector welding-tabs 20*a* and the lower fuse welding-tabs 24*a* so that the connector welding-tabs 20*a* are disposed between the fuse welding-tabs 24*a* and the relay welding-tabs 22*a* to form a triple-layer. The tabs in the triple-layer are welded together with each other.

The fuse casing 18 covers the fuse module 17 disposed vertically on a side of the connector module 14. The press contact terminals 23*a* and 24*a* of the fuse module 17 extend into the fuse containing section 18*a*.

Figure 3:
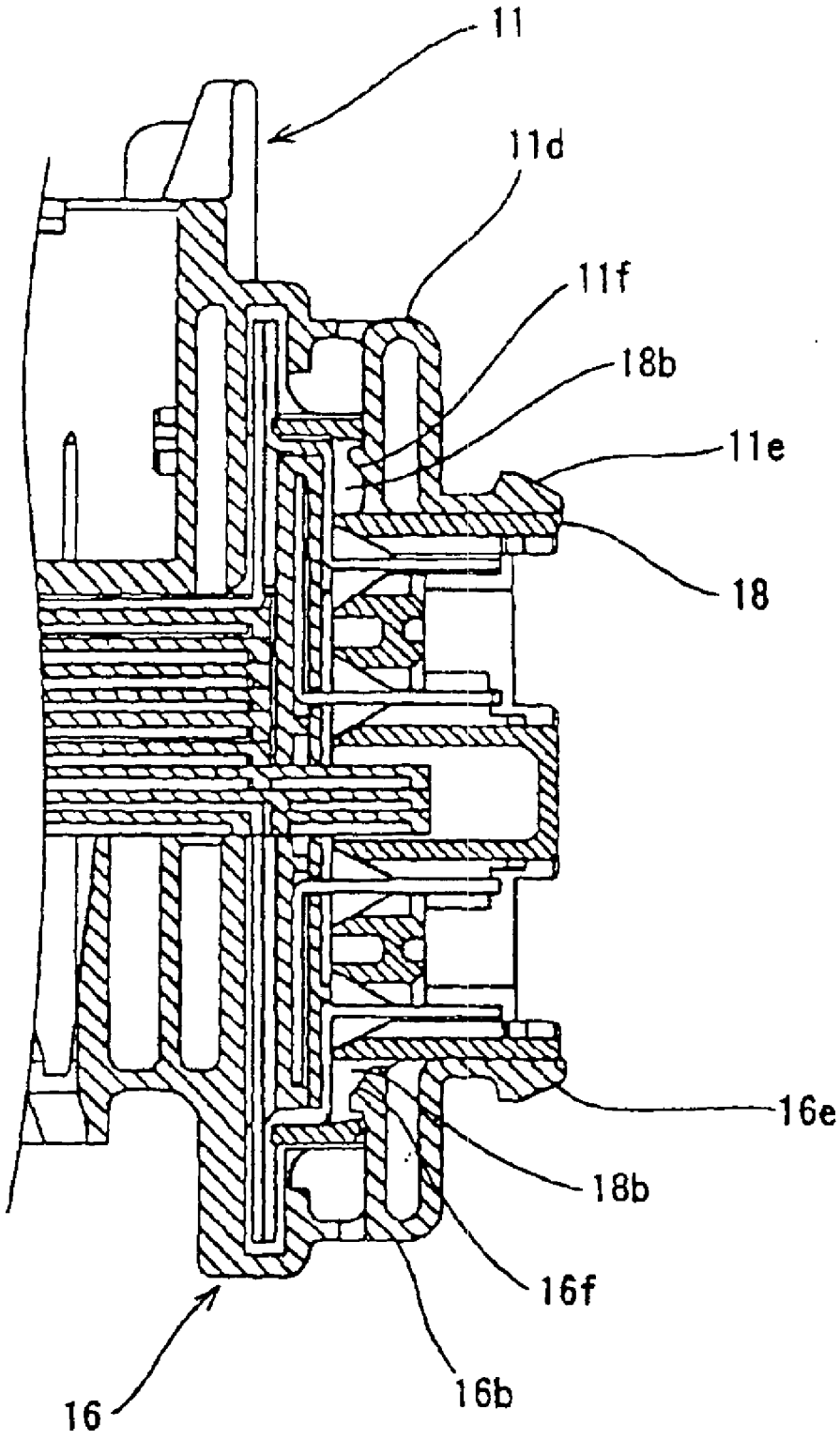
FIG. 3 is a sectional view of a main part of the junction box, illustrating positions after the upper and lower casing members are assembled.

As shown in FIG. 2, under this condition, when the upper and lower casing members 11 and 16 clamp the fuse module 17 in a vertical direction, the arms 11*g* and 16*g* of the fuse casing locking-portions 11*d* and 16*b* are deflected, as shown in FIG. 3, and the locking pawls 11*f* and 16*f* on the distal ends of the arms 11*g* and 16*g* are latched in the locking holes 18*b* in the fuse casing 18.

Figure 4:
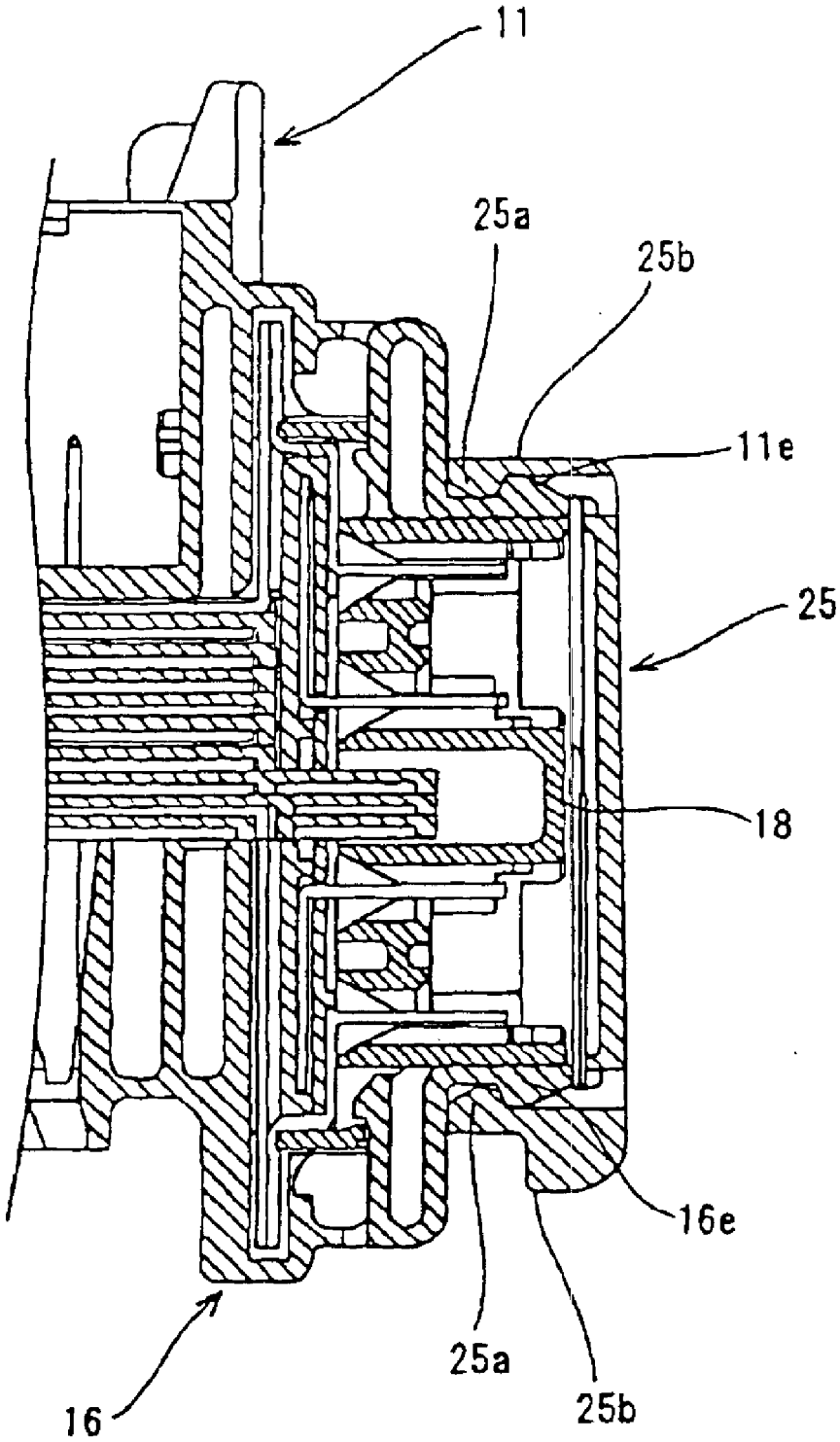
FIG. 4 is a sectional view of a main part of the junction box, illustrating positions after a fuse cover is attached to the junction box.

Finally, as shown in FIG. 4, when the peripheral wall 25*b* of the fuse cover 25 is fitted on the upper and lower casing members 11 and 16 at the side of the side opening 11*c* and the fuse casing 17 covers the fuse module 18 laterally, the locking pawls 25*a* of the fuse cover 25 engage the cover locking-portions 11*e* and 16*e* of the upper and lower casing members 11 and 16. (In FIGS. 2 to 4, the fuses 30 are omitted to clarify the drawings.)

According to the above structure, since the fuse casing locking-portions 11*d* and 16*b* of the upper and lower casing members 11 and 16 engage the locking holes 18*b* in the fuse casing 18, the fuse casing 18 serves to interlock the upper and lower casing members 11 and 16. Even if the portion being locked 11*b* of the upper casing member 11 is unlocked from the locking pawl 16*a* of the lower casing member 16 when opposite sidewalls 11*a* of the side opening 11*c* are opened outwardly, the upper and lower casing members are prevented from being separated away from each other.

Assembling work will become more efficient, since the arms 11*g* and 16*g* are deflected and the locking pawls 11*f* and 16*f* automatically engage the locking holes 18*b*. By enclosing the fuse casing 18 laterally to the side of the connector module 14 perpendicular to the upper and lower casing members 11 and 16.

Since the interlocking between the upper and lower casing members 11 and 16 are effected in the fuse cover 25 and the fuse casing 18, it is possible to secure the upper and lower casing members 11 and 16 to each other more firmly.

While the present invention has been particularly described, in conjunction with a specific preferred embodiment, it is evident that many alternatives, modifications, and variations will be apparent to those skilled in the art in light of the foregoing description. It is therefore contemplated that the appended claims will embrace any such alternatives, modifications, and variations as falling within the true scope and spirit of the present invention.

What is claimed is:

1. A junction box that comprising:

a fuse module having an insulation board on which a bus bar is secured, said bus bar being connected to terminals of each of a plurality of fuses mounted in a fuse casing in a juxtaposed manner;

an upper casing member provided with a side opening to which the fuse module is attached;

a lower casing member;

fuse casing locking-portions that project from an upper casing member surface of said upper casing member and a lower casing member surface of said lower casing member at said side opening;

portions being locked are provided in said fuse casing to engage said fuse casing locking-portions on said upper and lower casing members; and said upper and lower casing members are interlocked through said fuse casing.

2. A junction box according to claim 1, wherein a fuse cover is mounted on an exterior of said fuse casing, said portions being locked are provided on a peripheral wall of said fuse cover; cover locking portions are provided on a distal end of each of said upper and lower casing member surfaces that said fuse casing locking portions project, and said cover locking-portions engage said portions being locked.

3. A junction box according to claim 2, wherein said fuse casing has an upper fuse casing surface and a lower fuse casing surface, and each of said upper and lower fuse casing surfaces has locking holes provided on a stepped portion projecting from each of said upper and lower fuse casing surfaces so that said locking holes serve as said portion being locked;

wherein arms that project into said side opening are provided on said upper surface of said upper casing member and said lower surface of said lower casing member, said upper and lower surfaces are attached to said fuse casing vertically, locking pawls for said fuse casing locking-portions are provided on said arms, and said locking pawls are inserted into said locking holes in said fuse casing; and wherein a locking pawl is provided on a distal end of each of said upper and lower surfaces of said upper and lower casing members so that said locking pawl serves as said cover locking-portion, said locking pawls of said portions being locked on the periphery of said fuse cover are interlocked.

4. A junction box according to claim 1, wherein a connector module includes a circuit and is contained in an interior of a box including said upper and lower casing members, a relay module is attached to an opening in one of said upper casing member and said lower casing member; and wherein said connector module includes an insulation board and a bus bar secured to said insulation board and said relay module includes an insulation board and a bus bar that is connected to terminals of a relay.

5. A junction box according to claim 2, wherein a connector module circuit contained in an interior of a box including said upper and lower casing members, a relay module is attached to an opening in one of said upper casing member and said lower casing member; and wherein said connector module includes an insulation board and a bus bar secured to said insulation board and said relay module includes an insulation board and a bus bar that is connected to terminals of a relay.

6. A junction box according to claim 3, wherein a connector module includes a circuit contained in an interior of a box including said upper and lower casing members, a relay module is attached to an opening in one of said upper casing member and said lower casing member; and wherein said connector module includes an insulation board and a bus bar secured to said insulation board and said relay module includes an insulation board and a bus bar that is connected to terminals of a relay.

* * * * *